US009160113B2

(12) United States Patent
Yu et al.

(10) Patent No.: US 9,160,113 B2
(45) Date of Patent: Oct. 13, 2015

(54) ELECTRICAL CONNECTOR WITH ENGAGING ARMS FORMED ON COVER

(71) Applicant: ALLTOP ELECTRONICS (SUZHOU) CO., LTD., Taicang, JiangSu Province (CN)

(72) Inventors: Wang-I Yu, Jhonghe (TW); Hung-Chi Tai, Jhonghe (TW); Chun-Hsien Wu, Jhonghe (TW); Siu-Mien Yang, Jhonghe (TW)

(73) Assignee: ALLTOP ELECTRONICS (SUZHOU) LTD., Taicang, JiangSu Province (CN)

( * ) Notice: Subject to any disclaimer, the term of this patent is extended or adjusted under 35 U.S.C. 154(b) by 0 days.

(21) Appl. No.: 14/134,900

(22) Filed: Dec. 19, 2013

(65) Prior Publication Data

US 2015/0087186 A1 Mar. 26, 2015

(30) Foreign Application Priority Data

Sep. 26, 2013 (CN) ..... 2013 1 0442862

(51) Int. Cl.
*H01R 13/648* (2006.01)
*H01R 13/6582* (2011.01)
*H01R 24/64* (2011.01)

(52) U.S. Cl.
CPC ..... *H01R 13/6582* (2013.01); *H01R 24/64* (2013.01)

(58) Field of Classification Search
CPC ..... H01R 24/64; H01R 23/6873; H01R 13/6594; H01R 13/518; H01R 13/6583; H01R 12/724; H01R 13/6582
See application file for complete search history.

(56) References Cited

U.S. PATENT DOCUMENTS

| | | | | |
|---|---|---|---|---|
| 7,677,926 | B1 * | 3/2010 | Huang | 439/607.38 |
| 8,070,533 | B1 * | 12/2011 | Tai et al. | 439/681 |
| 2006/0052005 | A1 * | 3/2006 | Zhang et al. | 439/607 |

* cited by examiner

*Primary Examiner* — Xuong Chung Trans
(74) *Attorney, Agent, or Firm* — Sughrue Mion, PLLC

(57) ABSTRACT

An electrical connector includes an insulative housing, a number of contacts retained in the insulative housing and a cover shielding the insulative housing. The insulative housing includes a top wall, a pair of side walls and a plug-receiving cavity formed thereby. Each contact includes a resilient contacting portion extending into the plug-receiving cavity. The cover includes a top plate covering the top wall and a pair of side plates respectively covering the pair of side walls. Each side plate includes an engaging arm extending inwardly therefrom. The insulative housing defines a pair of cutouts formed at boundaries of the top wall and the pair of side walls. The pair of engaging arms extend into the plug-receiving cavity through the pair of cutouts, respectively.

18 Claims, 8 Drawing Sheets

ELECTRICAL CONNECTOR WITH ENGAGING ARMS FORMED ON COVER

BACKGROUND OF THE INVENTION

1. Field of the Invention

The present invention relates to an electrical connector, and more particularly, to a RJ 45 connector mounted to a circuit board.

2. Description of Related Art

With rapid development electronic technologies, electrical connectors have been widely used in electronic devices for exchanging information and data with external devices. An electrical connector usually includes an insulative housing, a plurality of contacts received in the insulative housing and a cover shielding the insulative housing for EMI protection. Soldering portions of the contacts usually extend beyond the insulative housing for being mounted to a circuit board.

In order to meet the requirements of stable signal transmission and high effective transmission of the electronic devices, strong mating stabilization of electrical connectors needs to be ensured. As a result, it is very important for accurately assembling the electrical connectors. If the electrical connectors are incorrectly assembled, the electrical connectors will not only mismatch the mating connectors, but also be damaged. However, the covers of conventional RJ 45 connectors are of whole-encompassing configurations, either in a single piece or in two pieces. As a result, the covers are complex and easily misassembled during connector assembling.

Hence, an electrical connector with an improved cover is desired to solve the above problems.

BRIEF SUMMARY OF THE INVENTION

The present invention provides an electrical connector including an insulative housing, a plurality of contacts retained in the insulative housing and a cover shielding the insulative housing. The insulative housing includes a top wall, a pair of side walls extending downwardly from opposite lateral sides of the top wall, and a plug-receiving cavity formed by the top wall and the side walls. The plug-receiving cavity extends forwardly through a front mating surface of the insulative housing in a first direction. Each contact includes a resilient contacting portion extending into the plug-receiving cavity. The cover includes a top plate covering the top wall and a pair of side plates respectively covering the pair of side walls. Each side plate includes an engaging arm extending inwardly therefrom. The insulative housing defines a pair of cutouts formed at boundaries of the top wall and the pair of side walls. Each cutout is located behind the front mating surface in the first direction. The pair of cutouts are in communication with the plug-receiving cavity. The pair of engaging arms extend into the plug-receiving cavity through the pair of cutouts, respectively. As a result, the cover can be easily and correctly assembled to the insulative housing with high efficiency.

The foregoing has outlined rather broadly the features and technical advantages of the present invention in order that the detailed description of the invention that follows may be better understood. Additional features and advantages of the invention will be described hereinafter which form the subject of the claims of the invention.

BRIEF DESCRIPTION OF THE DRAWINGS

The components in the drawing are not necessarily drawn to scale, the emphasis instead being placed upon clearly illustrating the principles of the described embodiments. In the drawings, reference numerals designate corresponding parts throughout various views, and all the views are schematic.

DETAILED DESCRIPTION OF THE PREFERRED EMBODIMENT

Figure 1:
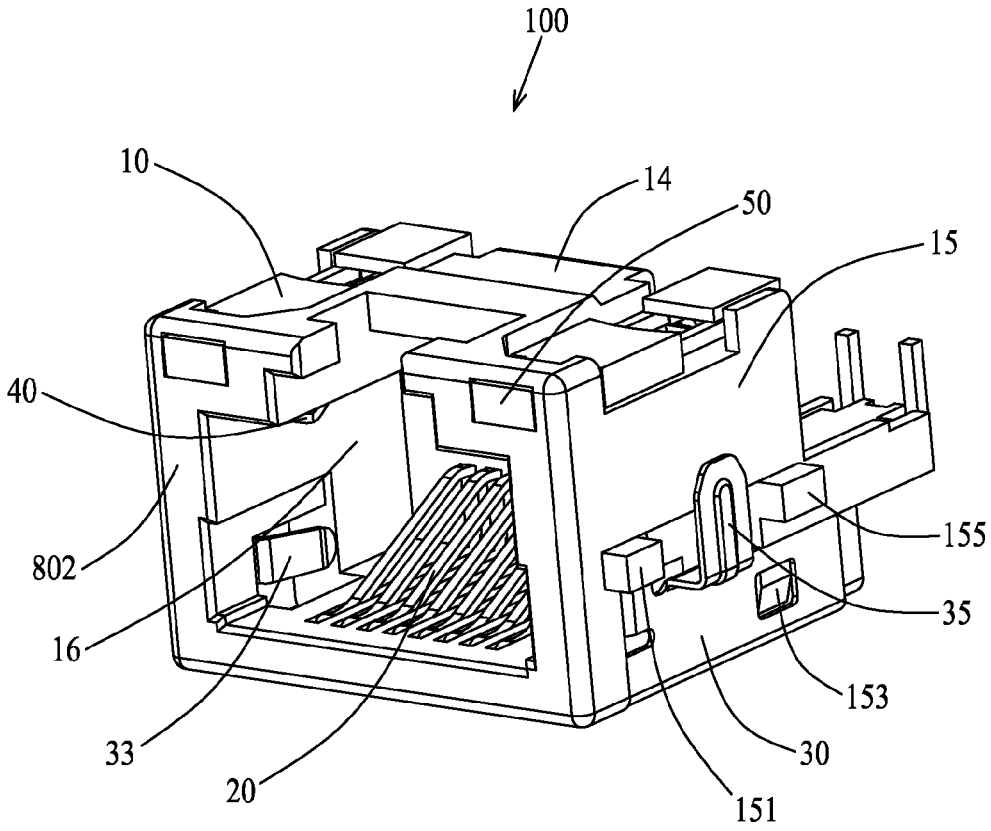
FIG. 1 is a perspective view of an electrical connector in accordance with an illustrated embodiment of the present invention.

Reference will now be made to the drawing figures to describe the embodiments of the present invention in detail. In the following description, the same drawing reference numerals are used for the same elements in different drawings.

Figure 2:
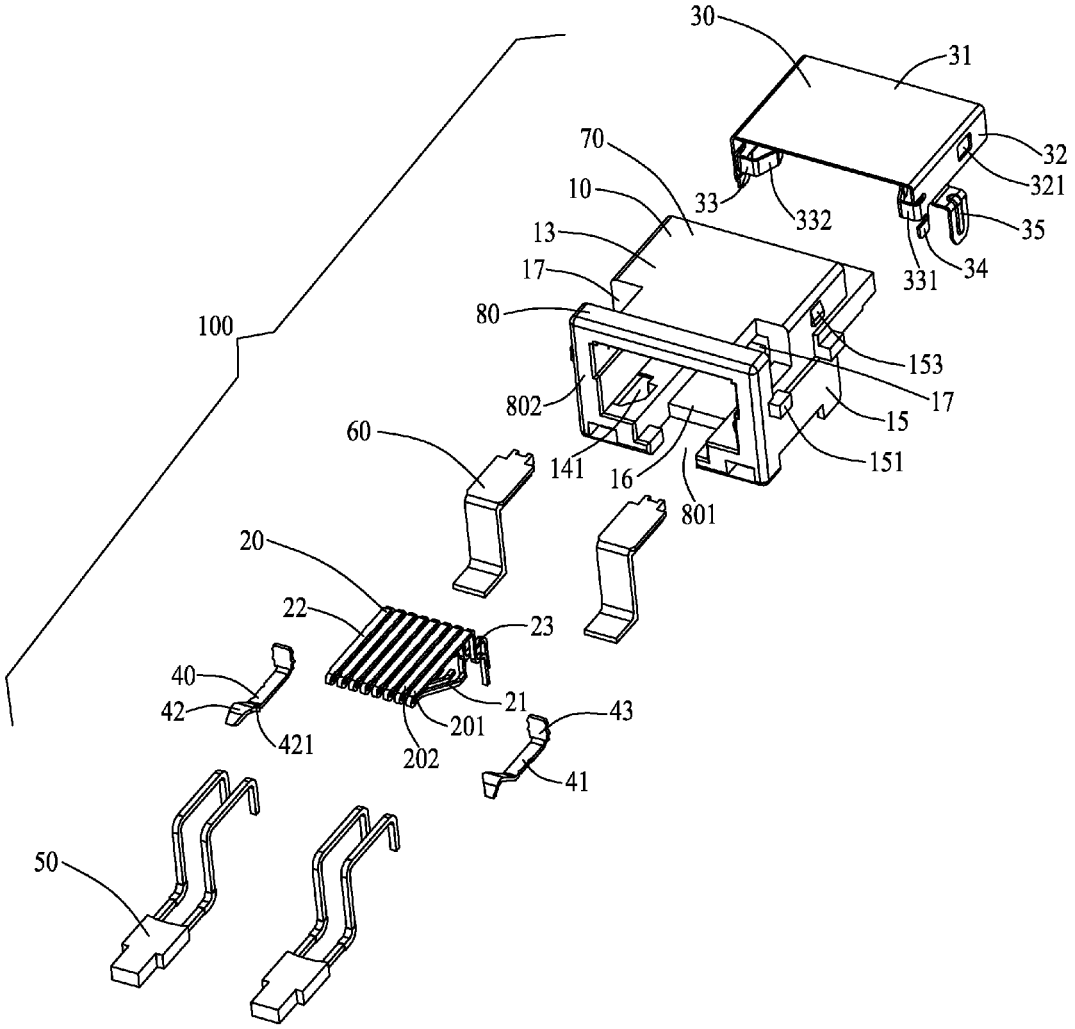
FIG. 2 is an exploded view of the electrical connector as shown in FIG. 1.

Referring to FIGS. 1 and 2, the present invention discloses an electrical connector 100 for being mounted to a circuit board (not shown) for receiving a plug connector (not shown). According to the illustrated embodiment of the present invention, the electrical connector 100 is a kind of RJ 45 connector. The electrical connector 100 includes an insulative housing 10, a plurality of contacts 20 retained in the insulative housing 10, a cover 30 shielding the insulative housing 10, a pair of deformable members 40 fixed to the insulative housing 10, a pair of LED members 50 assembled to the insulative housing 10, and a pair of L-shaped brackets 60 fixed to the insulative housing 10 to support the LED members 50.

Referring to FIGS. 2 to 5, the insulative housing 10 includes a body 70 and a frame 80 forwardly connecting with the body 70 along a first direction (i.e., a front and rear direction). The frame 80 is substantially rectangular shaped and is not totally enclosed because of a bottom opening 801. The frame 80 includes a front mating surface 802 for mating with the plug connector. The body 70 includes a rear wall 12, a top wall 13, a bottom wall 14 and a pair of side walls 15 extending downwardly from opposite lateral sides of the top wall 13. A plug-receiving cavity 16 is formed by the top wall 13, the bottom wall 14, the pair of side walls 15 and the rear wall 12. Besides, the plug-receiving cavity 16 further extends forwardly through the front mating surface 802 in the first direction. The frame 80 is higher than the top wall 13 so as to form a step 803 therebetween. The LED members 50 are exposed to the front mating surface 802 as shown in FIG. 1.

Figure 4:
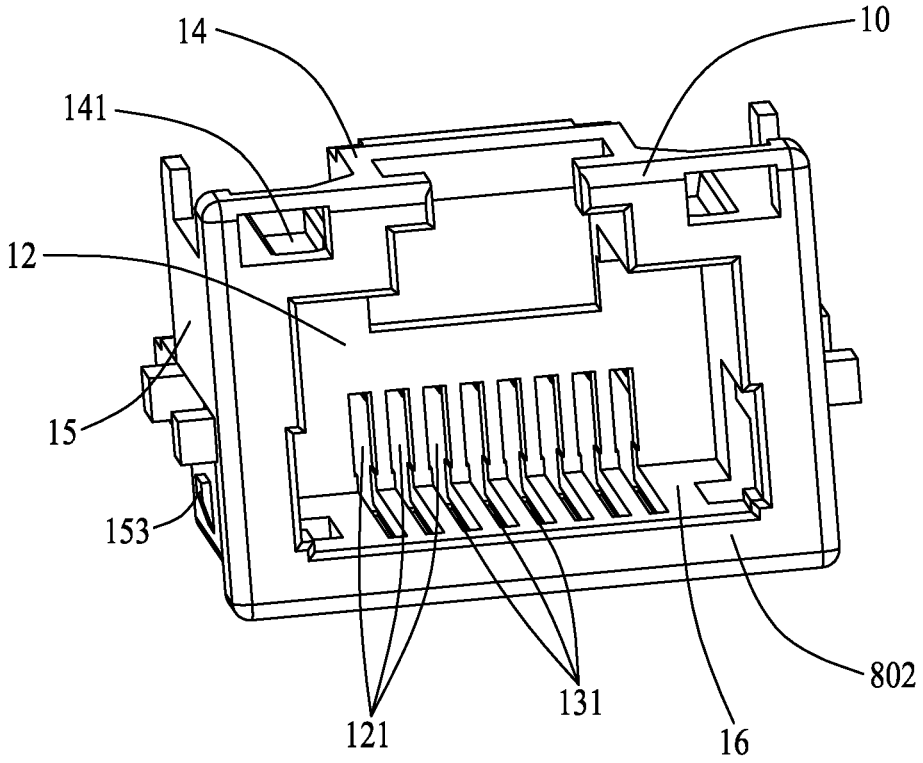
FIG. 4 is another perspective view of the insulative housing as shown in FIG. 3.
Figure 5:
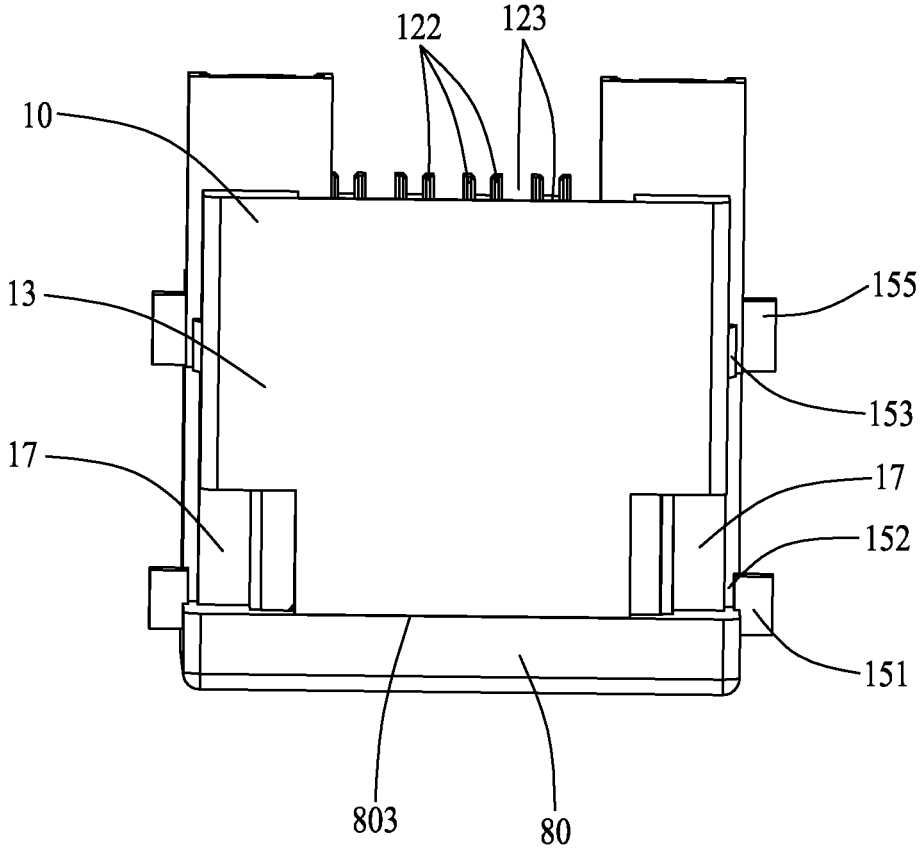
FIG. 5 is a top view of the insulative housing as shown in FIG. 3.

The insulative housing 10 includes a pair of cutouts 17 formed at boundaries of the top wall 13 and the pair of side walls 15. Each cutout 17 is located behind the front mating surface 802 in the first direction. The pair of cutouts 17 are in communication with the plug-receiving cavity 16. As shown in FIG. 4, the rear wall 12 includes a plurality of slots 121 extending rearwardly therethrough. A bottom side of the top wall 13 defines a plurality of passageways 131 extending rearwardly through the rear wall 12. The slots 121 and the passageways 131 are in communication with each other for cooperatively receiving the contacts 20. As shown in FIG. 5, the rear wall 12 further includes a plurality of ribs 122 and a plurality of positioning grooves 123 between each adjacent two ribs 122 for positioning the contacts 20.

Figure 3:
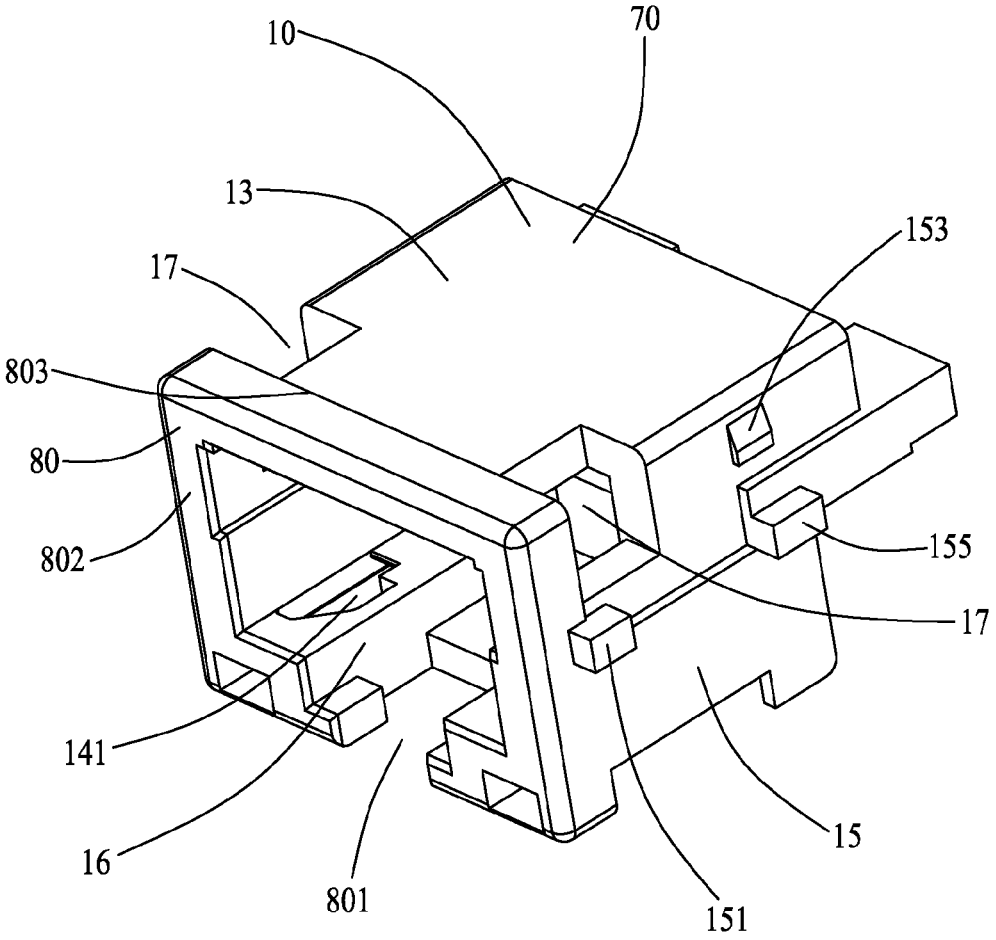
FIG. 3 is a perspective view of an insulative housing of the electrical connector as shown in FIG. 2.
Figure 8:
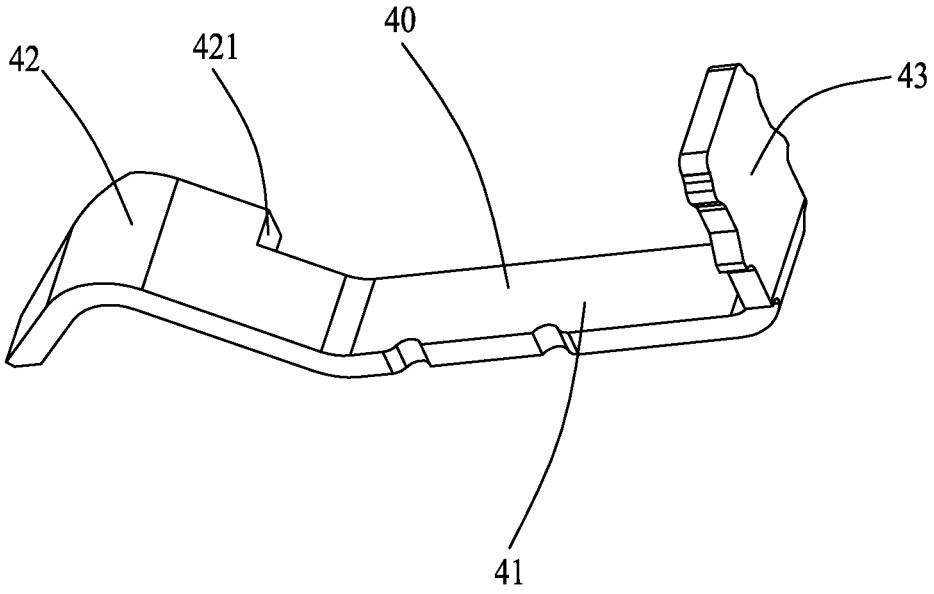
FIG. 8 is a perspective view of a deformable member of the electrical connector as shown in FIG. 2.

Referring to FIGS. 2 and 3, the bottom wall 14 defines a pair of slots 141 in communication with the plug-receiving cavity 16. The slots 141 extend partly through the bottom wall 14. The deformable members 40 are fixed in the pair of slots 141 and further extend upwardly into the plug-receiving cavity 16 for preventing insertion of an incorrect plug connector. According to the illustrated embodiment of the present invention, the deformable members 40 are made of metal. As shown in FIG. 8, each deformable member 40 is L-shaped and includes a flat portion 41, a curved elastic portion 42 extending forwardly from the flat portion 41 and a retaining portion 43 bent perpendicularly from the flat portion 41. The elastic portion 42 includes a widen portion 421 for engaging with the bottom wall 14 so as to prevent the deformable member 40 from moving along the first direction.

Referring to FIGS. 1 to 5, each side wall 15 includes a front block 151 and a rear block 155 in alignment with the front block 151 along the first direction. The front block 151 and the rear block 155 protrude sidewardly and outwardly from corresponding side wall 15. Referring to FIG. 1, it is understandable that both the front block 151 and the rear block 155 can be used to position the circuit board. The front block 151 stretches the frame 80 and the side wall 15 and is located adjacent to the front mating surface 802. The front block 151 includes a slit 152 as shown in FIG. 5 for mating with the cover 30. Besides, each side wall 15 further includes a fixed block 153 at the rear of the cutout 17 along the first direction. The front block 151 and the rear block 155 are located below the fixed block 153.

Figure 6:
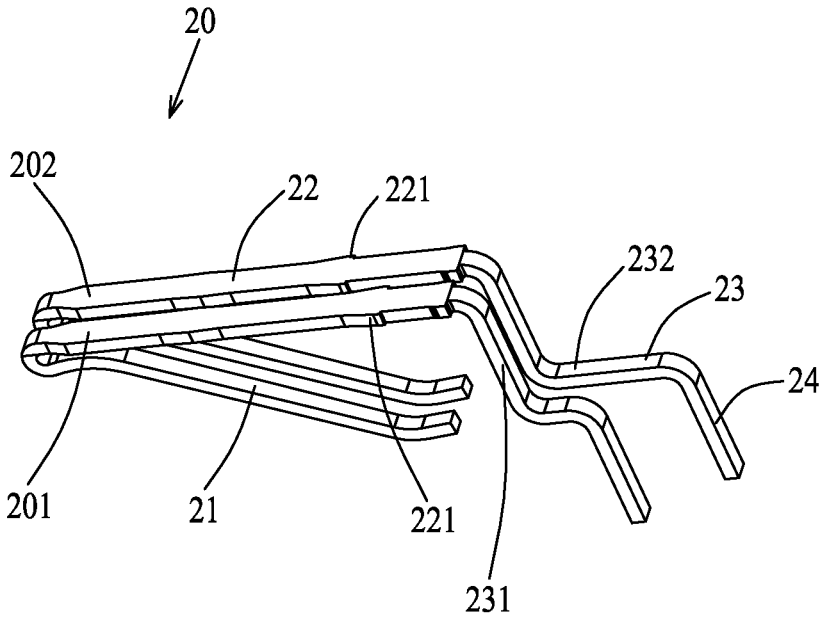
FIG. 6 is a perspective view of some contacts of the electrical connector as shown in FIG. 2.

Referring to FIGS. 2 and 6, the contacts 20 include a plurality of first contacts 201 and a plurality of second contacts 202 alternately arranged with each other along a sideward direction (i.e., a left and right direction) perpendicular to the first direction. Each contact 20 includes a fixing portion 22 received in the passageways 131, a resilient contacting portion 21 extending backwardly and slantly from a front end of the fixing portion 22, a L-shaped portion 23 bent from a rear end of the fixing portion 22, and a soldering portion 24 bent downwardly from the L-shaped portion 23 for being mounted to the circuit board. The contacting portions 21 extend into the plug-receiving space 16 for mating with the plug connector to establish signal transmission. The fixing portion 22 includes a plurality of barbs 221 which rigidly engage with inner sides of the passageways 131 by interference fit. The L-shaped portion 23 includes a vertical portion 231 received in the slot 121 and a horizontal portion 232 positioned in the positioning grooves 123. Each soldering portion 24 extends downwardly beyond the insulative housing 10 for being soldered to the circuit board. The horizontal portions 232 of the first contacts 201 and the second contacts 202 are different in length so that the soldering portions 24 of the contacts 20 are regulated along the first direction in at least two rows.

Figure 7:
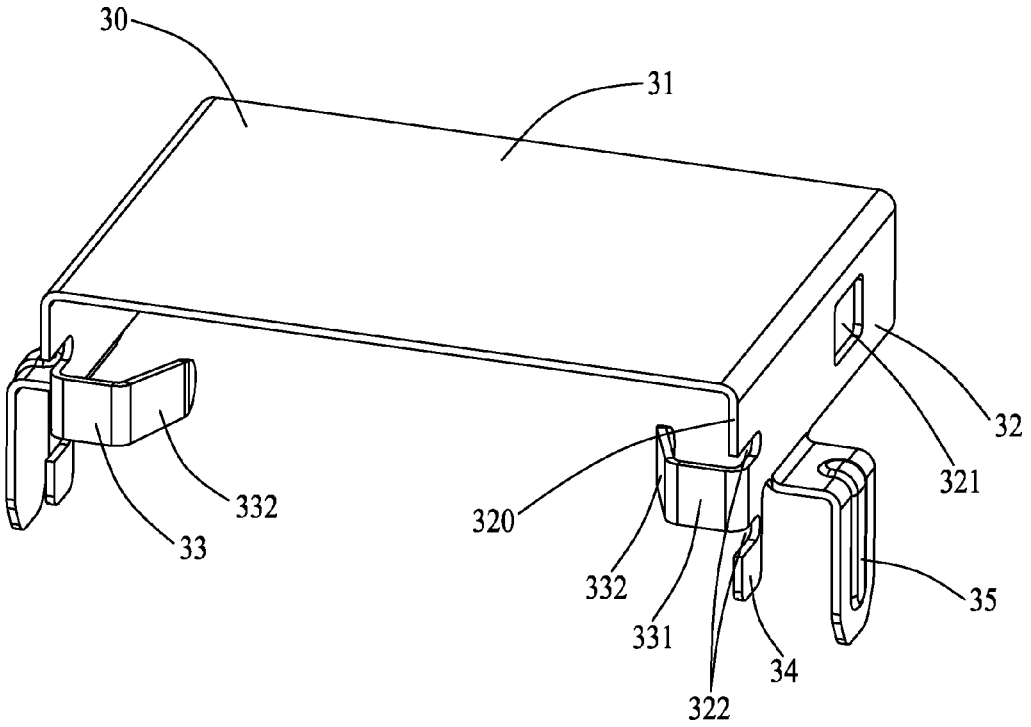
FIG. 7 is a perspective view of a cover of the electrical connector as shown in FIG. 2.

Referring to FIGS. 2 and 7, the cover 30 is of one piece and is bottom open. According to the illustrated embodiment of the present invention, the cover 30 is made of metal and includes a top plate 31 covering the top wall 13 and a pair of side plates 32 respectively covering the pair of side walls 15. Each side plate 32 includes a front edge 320, an engaging arm 33 extending inwardly and rearwardly from the front edge 320, a rectangular opening 321 opposite to the engaging arm 33 and an L-shaped mounting leg 35 positioned between the engaging arm 33 and the opening 321 in the first direction. The mounting leg 35 extends sidewardly and downwardly from a bottom edge of the side plate 32 for being mounted to the circuit board. Each engaging arm 33 includes a first resilient portion 331 extending inwardly from the front edge 320 and a second resilient portion 332 further bent slantwise and backwardly from the first resilient portion 331. Besides, in order to realize simple manufacture and improve the elasticity of the engaging arm 33, each side plate 32 includes a pair of small notches 322 recessed from the front edge 320 with corresponding first resilient portion 331 positioned between the pair of small notches 322. Each side plate 32 further includes a fixing piece 34 below the first resilient portion 331.

Referring to FIG. 3, in assembling, the cover 30 is downwardly assembled to the insulative housing 10 along a second direction (i.e., a top-to-bottom direction) perpendicular to the first direction. The pair of cutouts 17 are large enough so that the pair of engaging arms 33 can be assembled in position without any deformation thereof, when the cover 30 is assembled to the insulative housing 10. The first resilient portions 331 are positioned mainly occupying thickness of the side walls 15 for space saving. Each first resilient portion 331 is perpendicular to corresponding side plate 32. The second resilient portions 332 extend into the plug-receiving cavity 16 for abutting against the plug connector. Besides, the fixed blocks 153 are locked in the openings 321 so as to prevent the cover 30 from escaping the insulative housing 10 along a bottom-to-top direction. The fixing pieces 34 are fastened in the slits 152. A front end of the top plate 31 is restricted by the step 803 along the first direction. As a result, the cover 30 can be easily and correctly assembled to the insulative housing 10 with high efficiency.

It is to be understood, however, that even though numerous characteristics and advantages of preferred and exemplary embodiments have been set out in the foregoing description, together with details of the structures and functions of the embodiments, the disclosure is illustrative only; and that changes may be made in detail within the principles of present disclosure to the full extent indicated by the broadest general meaning of the terms in which the appended claims are expressed.

What is claimed is:

1. An electrical connector comprising:

an insulative housing comprising a top wall, a pair of side walls extending downwardly from opposite lateral sides of the top wall and a plug-receiving cavity formed by the top wall and the side walls, the plug-receiving cavity extending forwardly through a front mating surface of the insulative housing in a first direction;

a plurality of contacts each comprising a resilient contacting portion extending into the plug-receiving cavity;

a cover shielding the insulative housing and comprising a top plate covering the top wall and a pair of side plates respectively covering the pair of side walls, each side plate comprising an engaging arm extending inwardly therefrom; wherein the insulative housing defines a pair of cutouts formed at boundaries of the top wall and the pair of side walls, each cutout being located behind the front mating surface in the first direction, the pair of cutouts being in communication with the plug-receiving cavity, the pair of engaging arms extending into the plug-receiving cavity through the pair of cutouts, respectively;

wherein each side plate comprises a front edge, each engaging arm comprising a first resilient portion extending from the front edge and a second resilient portion further bent slantwise and backwardly from the first resilient portion, the second resilient portion extending into the plug-receiving cavity;

wherein each side plate defines a pair of small notches recessed from the front edge with corresponding first resilient portion positioned between the pair of small notches.

2. The electrical connector as claimed in claim 1, wherein the cover is downwardly assembled to the insulative housing along a second direction perpendicular to the first direction.

3. The electrical connector as claimed in claim 2, wherein the pair of cutouts are large enough so that the pair of engaging arms can be assembled in position without any deformation thereof when the cover is assembled to the insulative housing.

4. The electrical connector as claimed in claim 1, wherein the first resilient portion is positioned mainly occupying a thickness of the side wall, the first resilient portion being perpendicular to the side plate.

5. The electrical connector as claimed in claim 1, wherein each side plate comprises a fixing piece below the first resilient portion, each side wall comprises a block protruding sidewardly and outwardly therefrom, and the block defines a slit to fasten the fixing piece along a top-to-bottom direction.

6. The electrical connector as claimed in claim 1, wherein each side plate defines an opening opposite to the engaging arm, and each side wall comprises a fixed block locked in the opening so as to prevent the cover from escaping the insulative housing.

7. The electrical connector as claimed in claim 6, wherein each side plate comprises a L-shaped mounting leg extending sidewardly and downwardly from a bottom edge of the side plate for being mounted to a circuit board, the mounting leg being positioned between the engaging arm and the opening in the first direction.

8. The electrical connector as claimed in claim 1, wherein the insulative housing comprises a bottom wall opposite to the top wall and a rear wall opposite to the front mating surface, the plug-receiving cavity being corporately formed by the top wall, the bottom wall, the side walls and the rear wall; and wherein the bottom wall defines a pair of slots in communication with the plug-receiving cavity, and the electrical connector comprises a pair of deformable members fixed in the pair of slots and further extending upwardly into the plug-receiving cavity for preventing insertion of an incorrect plug connector.

9. An electrical connector comprising:

an insulative housing comprising a body and a frame forwardly connecting with the body, the frame defining a front mating surface, the body comprising a top wall, a bottom wall, a pair of side walls and a rear wall with a plug-receiving cavity formed thereby, the plug-receiving cavity extending forwardly through the front mating surface in a first direction, the frame being higher than the top wall so as to form a step therebetween;

a plurality of contacts each comprising a resilient contacting portion slantwise extending into the plug-receiving cavity;

a cover shielding the insulative housing and comprising a top plate covering the top wall and a pair of side plates respectively covering the pair of side walls, a front end of the top plate being restricted by the step along the first direction, each side plate comprising an engaging arm extending inwardly therefrom; wherein the insulative housing defines a pair of cutouts located behind the front mating surface along the first direction, the pair of cutouts are in communication with the plug-receiving cavity, and the pair of engaging arms extending into the plug-receiving cavity through the pair of cutouts, respectively;

wherein each side plate comprises a front edge, each engaging arm comprising a first resilient portion extending from the front edge and a second resilient portion further bent slantwise and backwardly from the first resilient portion, the second resilient portion extending into the plug-receiving cavity;

wherein each side plate defines a pair of small notches recessed from the front edge, and corresponding first resilient portion is positioned between the pair of small notches.

10. The electrical connector as claimed in claim 9, wherein the cover is downwardly assembled to the insulative housing along a second direction perpendicular to the first direction.

11. The electrical connector as claimed in claim 10, wherein the pair of cutouts are formed at boundaries of the top wall and the pair of side walls, and the pair of cutouts are large enough so that the pair of engaging arms can be assembled in position without any deformation thereof when the cover is assembled to the insulative housing.

12. The electrical connector as claimed in claim 9, wherein each side plate comprises a fixing piece below the first resilient portion, each side wall comprises a block protruding sidewardly and outwardly therefrom, and the block defines a slit to fasten the fixing piece along a top-to-bottom direction.

13. The electrical connector as claimed in claim 9, wherein each side plate defines an opening opposite to the engaging arm and a L-shaped mounting leg positioned between the engaging arm and the opening in the first direction, each side wall comprising a fixed block locked in the opening so as to prevent the cover from escaping the insulative housing.

14. The electrical connector as claimed in claim 9, wherein the bottom wall defines a pair of slots in communication with the plug-receiving cavity, and the electrical connector comprises a pair of deformable members fixed in the pair of slots and further extending upwardly into the plug-receiving cavity for preventing insertion of an incorrect plug connector.

15. The electrical connector as claimed in claim 14, wherein each deformable member comprises a widen portion for engaging with the bottom wall so as to prevent the deformable member from moving along the first direction.

16. The electrical connector as claimed in claim 9, further comprising a pair of LED members assembled to the insulative housing and a pair of L-shaped brackets fixed to the insulative housing to support the LED members, the LED members being exposed to the front mating surface.

17. An electrical connector comprising:

an insulative housing comprising a top wall, a pair of side walls extending downwardly from opposite lateral sides of the top wall and a plug-receiving cavity formed by the top wall and the side walls, the plug-receiving cavity extending forwardly through a front mating surface of the insulative housing in a first direction;

a plurality of contacts each comprising a resilient contacting portion extending into the plug-receiving cavity;

a cover shielding the insulative housing and comprising a top plate covering the top wall and a pair of side plates respectively covering the pair of side walls, each side plate comprising an engaging arm extending inwardly therefrom; wherein the insulative housing defines a pair of cutouts formed at boundaries of the top wall and the pair of side walls, each cutout being located behind the front mating surface in the first direction, the pair of cutouts being in communication with the plug-receiving cavity, the pair of engaging arms extending into the plug-receiving cavity through the pair of cutouts, respectively;

wherein the insulative housing comprises a bottom wall opposite to the top wall and a rear wall opposite to the front mating surface, the plug-receiving cavity being corporately formed by the top wall, the bottom wall, the side walls and the rear wall; and wherein the bottom wall defines a pair of slots in communication with the plug-receiving cavity, and the electrical connector comprises a pair of deformable members fixed in the pair of slots and further extending upwardly into the plug-receiving cavity for preventing insertion of an incorrect plug connector.

18. An electrical connector comprising:

an insulative housing comprising a body and a frame forwardly connecting with the body, the frame defining a front mating surface, the body comprising a top wall, a bottom wall, a pair of side walls and a rear wall with a plug-receiving cavity formed thereby, the plug-receiving cavity extending forwardly through the front mating surface in a first direction, the frame being higher than the top wall so as to form a step therebetween;

a plurality of contacts each comprising a resilient contacting portion slantwise extending into the plug-receiving cavity;

a cover shielding the insulative housing and comprising a top plate covering the top wall and a pair of side plates respectively covering the pair of side walls, a front end of the top plate being restricted by the step along the first direction, each side plate comprising an engaging arm extending inwardly therefrom; and a pair of LED members assembled to the insulative housing and a pair of L-shaped brackets fixed to the insulative housing to support the LED members, the LED members being exposed to the front mating surface;

wherein the insulative housing defines a pair of cutouts located behind the front mating surface along the first direction, the pair of cutouts are in communication with the plug-receiving cavity, and the pair of engaging arms extending into the plug-receiving cavity through the pair of cutouts, respectively.

* * * * *